US006070345A

United States Patent [19]

Akaki et al.

[11] Patent Number: 6,070,345

[45] Date of Patent: Jun. 6, 2000

[54] BUCKET TOOL FOR A POWER SHOVEL

[75] Inventors: Tsuyoshi Akaki, Utsunomiya; Yasuo Miyoshi, Tokyo, both of Japan

[73] Assignee: Mitsubishi Steel Mfg. Co., Ltd., Tokyo, Japan

[21] Appl. No.: 09/035,470

[22] Filed: Mar. 5, 1998

[30] Foreign Application Priority Data

Mar. 18, 1997 [JP] Japan ..... 9-064574

[51] Int. Cl.[7] ..... E02F 3/76

[52] U.S. Cl. ..... 37/407; 37/450; 37/458; 37/903

[58] Field of Search ..... 37/407, 443, 444, 37/446, 450, 452, 455, 456, 458, 903

[56] References Cited

U.S. PATENT DOCUMENTS

| | | | |
|---|---|---|---|
| 3,469,330 | 9/1969 | Hood et al. . | |
| 3,748,763 | 7/1973 | Zepf . | |
| 3,765,109 | 10/1973 | Daviduke | 37/141 R |
| 3,942,271 | 3/1976 | George | 37/117.5 |
| 4,009,529 | 3/1977 | Johnson . | |
| 4,043,060 | 8/1977 | Stepe . | |
| 4,208,815 | 6/1980 | Yunker et al. | 37/141 R |
| 5,253,449 | 10/1993 | Webb et al. . | |
| 5,596,825 | 1/1997 | Von Schalscha | 37/407 |
| 5,918,389 | 7/1999 | Hall . | |

FOREIGN PATENT DOCUMENTS

| | | |
|---|---|---|
| 9-78637 | 3/1997 | Japan . |
| 9-137477 | 5/1997 | Japan . |

*Primary Examiner*—H. Shackelford
*Attorney, Agent, or Firm*—Flynn, Thiel, Boutell & Tanis, P.C.

[57] ABSTRACT

A bucket tool comprising an edge 7 secured to the lower part of a bucket in a lateral direction, tooth-mounting fittings 8 secured to the edge 7 with an interval between the fittings in the lateral direction, excavation teeth 9 attachably/detachably mounted in the tooth-mounting fittings 8 and protruding forward beyond the edge 7, a ground-leveling plate 10 having a lateral width equal to the lateral width of the lower part of the bucket, and coupling fittings 11 secured to the upper surface of the ground-leveling plate 10 at an interval nearly equal to the interval between the tooth-mounting fittings 8 and capable of being detachably attached to the ends of the excavation teeth 9. Upon attaching or detaching the coupling fittings 11 secured to the upper surface of the ground-leveling plate 10 to, or from, the ends of the excavation teeth 9, the ground-leveling plate 10 can be easily attached to, or detached from, excavation teeth of a bucket for excavation.

2 Claims, 5 Drawing Sheets

BUCKET TOOL FOR A POWER SHOVEL

BACKGROUND OF THE INVENTION

1. Field of the Invention

The present invention relates to a bucket tool for a power shovel that can be used for excavation as well as for ground-leveling operation.

2. Description of the Prior Art

Referring to FIG. 5, a power shovel 1 used for construction work is equipped with a boom 2 that can be raised and lowered, and wherein a base end of an arm 3 is pivotably connected to an end of the boom 2, and a base portion of a bucket 4 is pivotably connected to another end of the arm 3. The front part of the bucket 4 is provided with a plurality of protruding excavation teeth 5 in an interval like a fork.

The power shovel 1 is horizontally turned to change the direction of the boom 2, the boom 2 is raised and lowered, and the arm 3 and the bucket 4 are turned, in order to excavate sand, soil, gravel, rock, etc. The excavated sand, soil, etc. are scooped up by the bucket 4 and are loaded onto a dump truck, etc.

After the excavation operation, the ground is usually leveled by any one of the following three methods.

(1) The ground is leveled by replacing the excavation bucket 4 with the excavation teeth 5 by a leveling bucket without the excavation teeth 5.

(2) A square steel plate having a width nearly equal to the width of the bucket 4 and a length nearly equal to the length of the excavation teeth 5, is welded onto the excavation teeth 5 protruding beyond the excavation bucket 4, and the ground is leveled by the end surface of the steel board.

(3) Detachable split teeth having a large width are fitted onto the excavation teeth 5 so as to overlap neighboring ones, and the ground is leveled by using the split teeth.

When the ground is leveled by replacing the bucket by the leveling bucket without the excavation teeth 5 of (1), however, each power shovel 1 must be provided with both the excavation bucket 4 and the ground-leveling bucket, accompanied by an increase in cost and a cumbersome operation for replacing the bucket on the site.

According to the method of welding the steel plate onto the excavation teeth 5 of the excavation bucket 4 of (2), the steel plate must be welded at the site, which is cumbersome. To carry out the excavation operation, next, furthermore, the steel plate welded onto the excavation teeth 5 must be removed which involves a cumbersome operation.

According to the method of leveling the ground by mounting broad detachable split teeth on the excavation teeth 5 of (3) so as to overlap each other, the split teeth are not flatly overlapped but are ruggedly overlapped by each other. Therefore, the ground is not flatly leveled, which is not suitable for a leveling operation where flatness is required. Besides, since the split teeth are broad, an increased load is exerted on each split tooth, and the portions where the split teeth are mounted on the excavation teeth 5 cannot withstand the use for extended periods of time.

SUMMARY OF THE INVENTION

The object of the present invention is to provide a bucket tool for a power shovel which enables a ground-leveling plate to be easily and detachably attached to the excavation teeth of the excavation bucket, so that both the excavation operation and the ground-leveling operation can be performed without being accompanied by a cumbersome operation, precluding the above-mentioned defects inherent in the prior art.

The present invention is concerned with a bucket tool for a power shovel comprising an edge secured to a front part of the bottom plate at the lower part of the bucket in a lateral direction, tooth-mounting fittings secured to the edge with an interval provided between the adjacent fittings in the lateral direction, excavation teeth detachably mounted on the tooth-mounting fittings and protruding forward beyond the edge, a ground-leveling plate having a lateral width equal to the lateral width of the lower part of the bucket, and coupling fittings secured to the upper surface of the ground-leveling plate with an interval nearly equal to the interval for securing the tooth-mounting fittings and capable of being attachably/detachably mounted on the ends of the excavation teeth, enabling the ground-leveling plate to be easily attached to, or detached from, the ends of the excavation teeth via coupling fittings.

As an embodiment, the above-mentioned bucket tool for a power shovel of the present invention further includes excavation tooth holes perforated through the ends of the excavation teeth, coupling fitting elongated holes perforating the coupling fittings and elongated in the lateral direction of the bucket, pins inserted in the excavation tooth holes and in the coupling fitting elongated holes to couple the excavation teeth and the coupling fittings together, and stop rings interposed between the excavation teeth and the coupling fittings and mounted to surround the pins, enabling the ground-leveling plate to be mounted without any trouble despite the positions of the excavation teeth and the positions of the coupling fittings of the ground-leveling plate not being in agreement in the lateral direction.

In this embodiment, the bucket tool for a power shovel may further include spacers interposed together with the stop rings between the excavation teeth and the coupling fittings, enabling the ground-leveling plate to be mounted without any trouble despite the positions of the excavation teeth being not uniform in the vertical direction.

DETAILED DESCRIPTION OF THE PREFERRED EMBODIMENTS

An embodiment of the invention will now be described with reference to the drawings.

Figure 4:
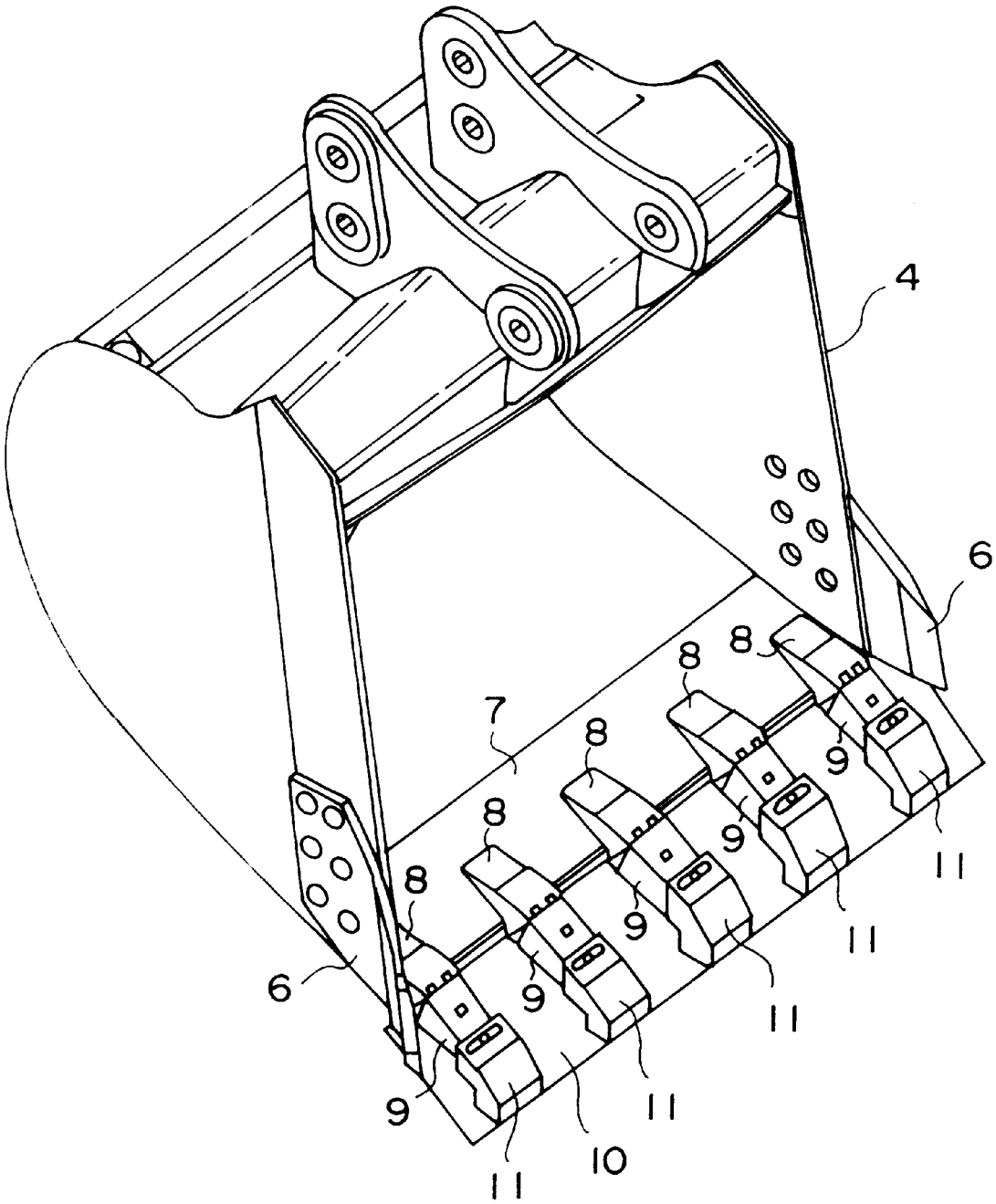
FIG. 4 is a perspective view illustrating the embodiment of the present invention.
Figure 5:
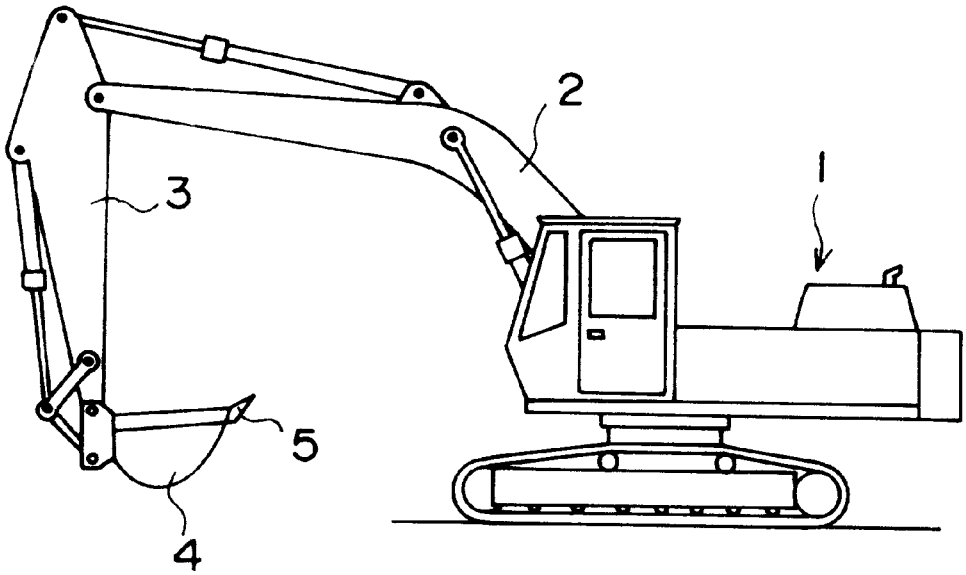
FIG.5 PRIOR ART
FIG. 5 is a side view of a conventional bucket of a power shovel.

FIG. 4 is a perspective view illustrating an embodiment of the present invention, wherein side shrouds 6 are secured to both sides of the bucket 4 near the lower portions thereof in the vertical direction, and an edge 7 is secured to a front part of the bottom plate of the bucket 4 in the lateral direction.

A plurality of tooth-mounting fittings 8 are secured to the front part of the edge 7 nearly with a predetermined interval provided between them in the lateral direction.

The tooth-mounting fittings 8 are formed solid, have a rectangular shape in transverse cross section and extend forward. Onto the tooth-mounting fittings 8 can be detachably mounted excavation teeth 9 in a manner as described below. Onto the excavation teeth 9 is further attachably/detachably mounted a ground-leveling plate 10 having a lateral width equal to the lateral width of the lower part of the bucket 4 via coupling fittings 11.

Figure 1:
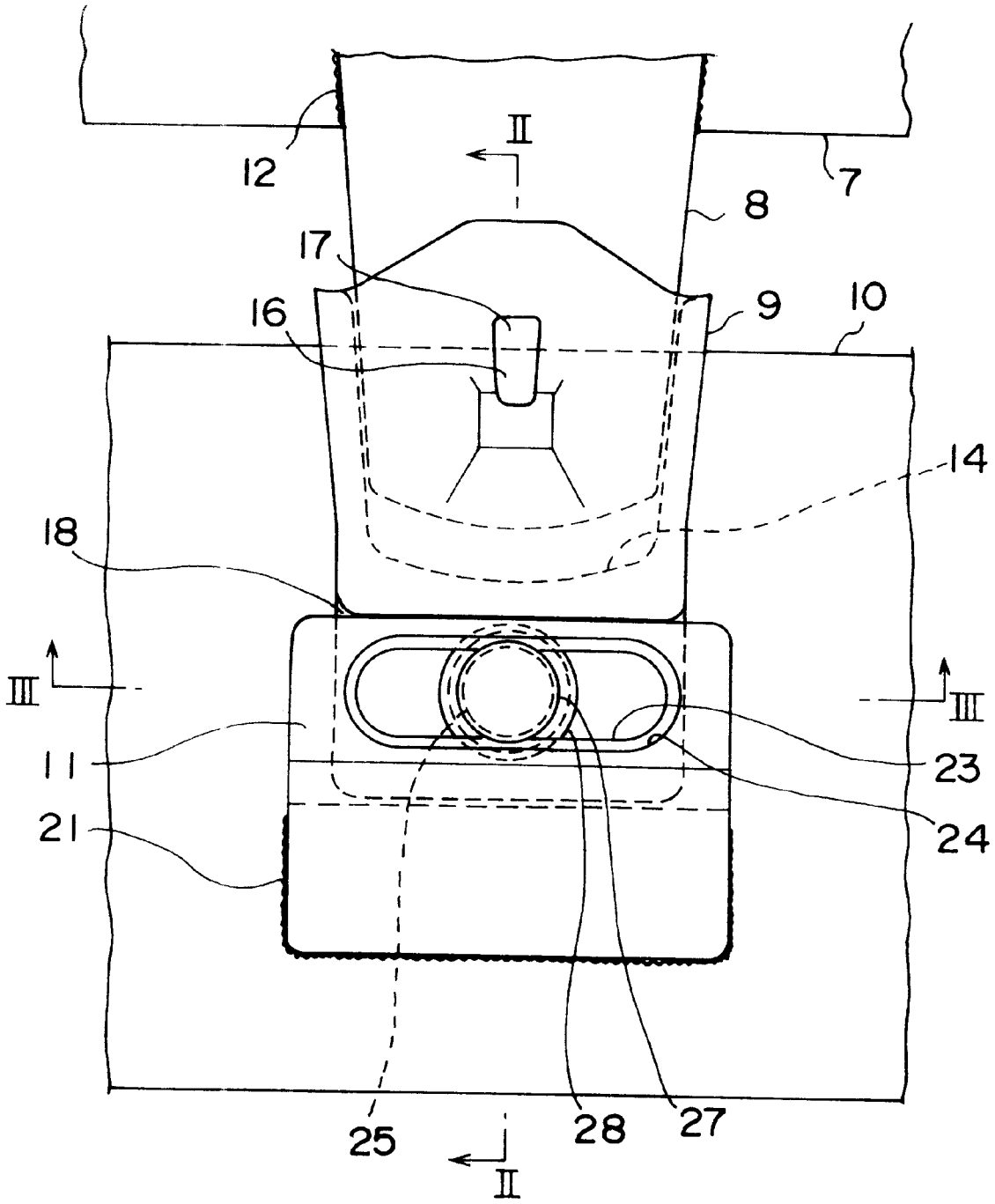
FIG. 1 is a plan view illustrating a major portion of an embodiment of the present invention.
Figure 2:
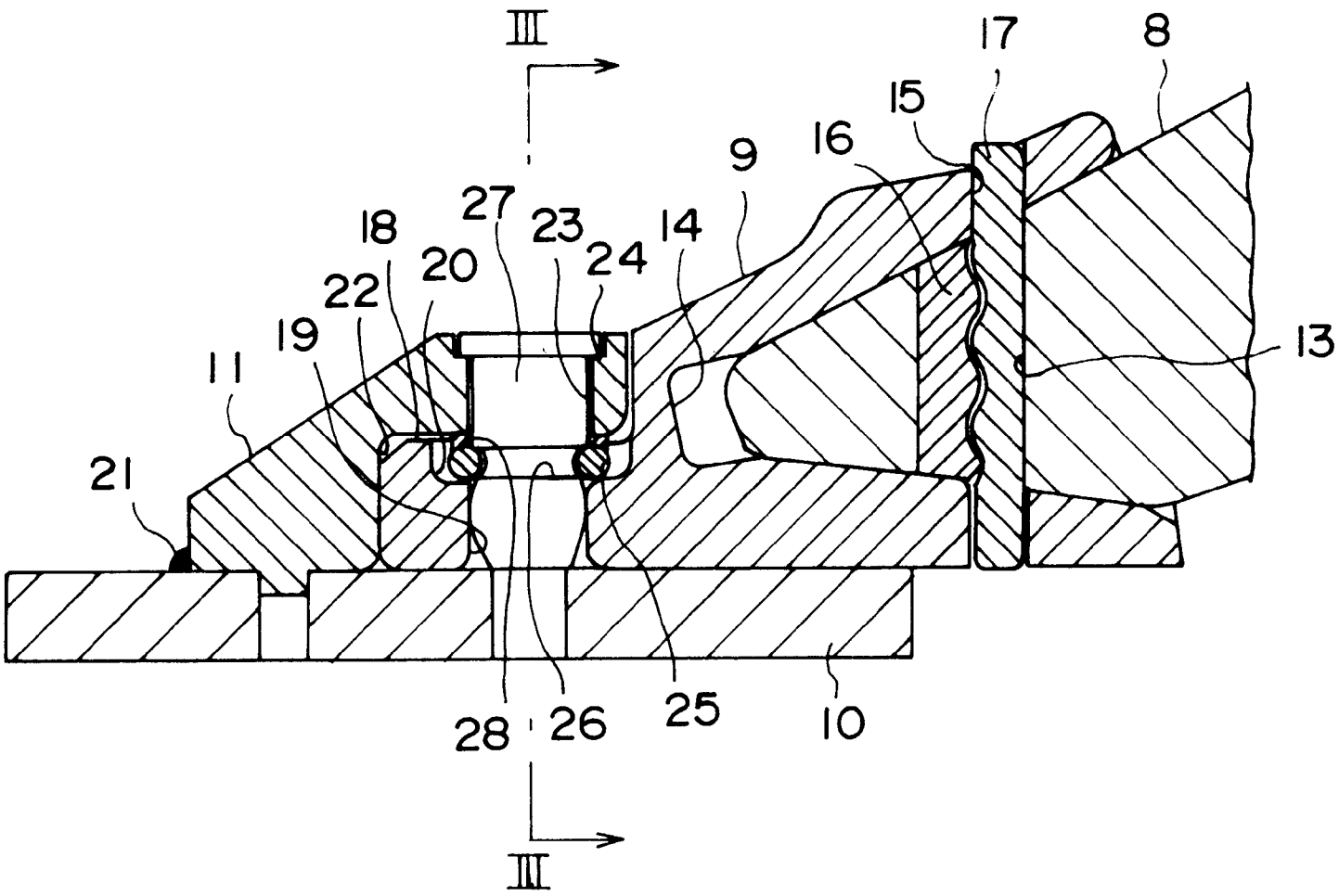
FIG. 2 is a vertical side view taken along the line II—II in FIG. 1.
Figure 3:
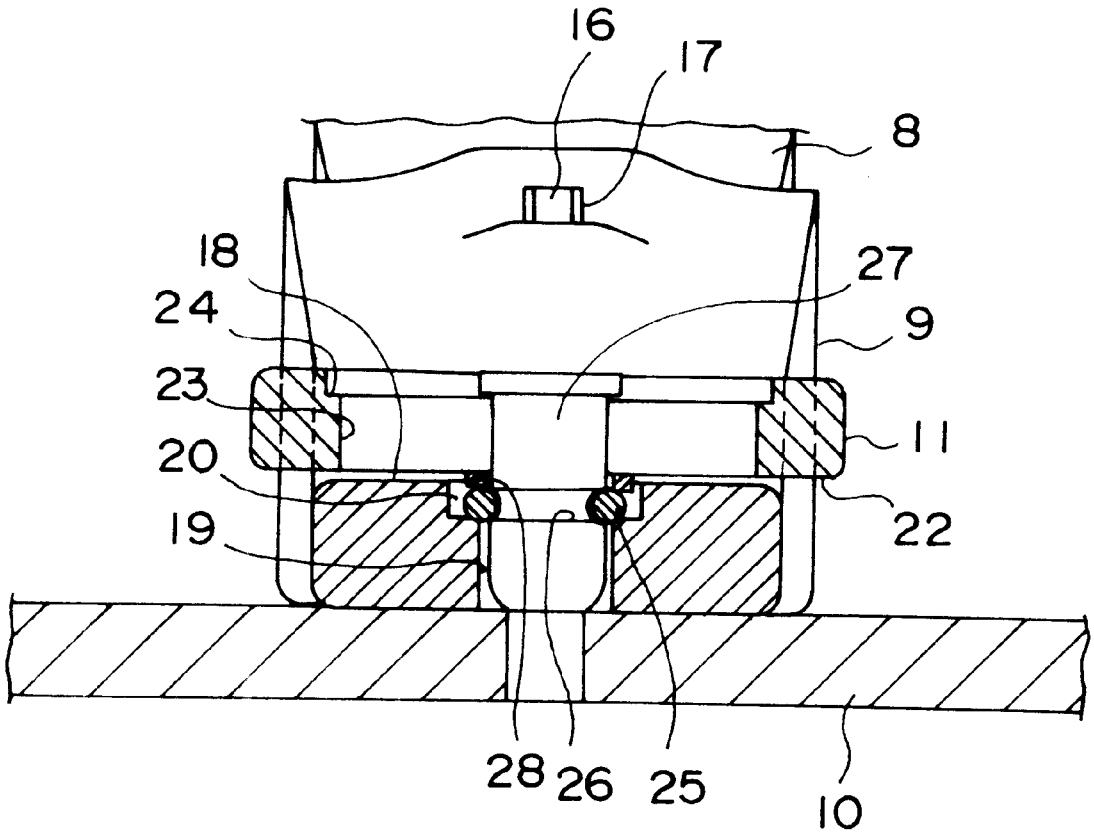
FIG. 3 is a vertical front view taken along the line III—III in FIG. 2.

FIG. 1 is a plan view illustrating, on an enlarged scale, a major portion equipped with the above-mentioned tooth-mounting fittings 8, the excavation teeth 9, the ground-leveling plate 10 and the coupling fittings 11 according to an embodiment of the present invention, FIG. 2 is a vertical side view taken along the line II—II in FIG. 1, and FIG. 3 is a vertical plan view taken along the line III—III in FIGS. 1 and 2, and wherein, as shown in FIG. 1, the tooth-mounting fittings 8 secured by welding 12 to the front part of the edge 7 protrude beyond the front part of the edge 7, and a hole 13 perforates the vertical direction in the end of the tooth-mounting fittings 8 as shown in FIG. 2.

The excavation tooth 9 attachably/detachably mounted on the end of the tooth-mounting fitting 8 has a fitting opening 14 which opens rearwardly as shown in FIGS. 1 and 2, and a hole 15 perforates a rear upper part of the fitting opening 14 as shown in FIG. 2. In FIG. 2, a plug 16 is inserted in the hole 13 in the tooth-mounting fitting 8 and, then, the fitting opening 14 in the excavation tooth 9 is fitted to the end of the tooth-mounting fitting 8. Next, a pin 17 is inserted in the hole 15 in the excavation tooth 9. The excavation tooth 9 is secured to the tooth-mounting fitting 8 in a state of being mounted on the end of the tooth-mounting fitting 8. Upon removal of the pin 17 toward the upper side or the lower side of the hole 15, it is possible to remove the excavation tooth 9 from the tooth-mounting fitting 8.

As shown in FIGS. 1 to 3, a low flat portion 18 is formed in the end of the excavation tooth 9 over the whole lateral width of the excavation tooth 9. A hole 19 for inserting a pin 27 is formed in the center of the flat portion 18, and a stepped portion 20 is formed at the upper peripheral edge thereof as shown in FIGS. 2 and 3.

The ground-leveling plate 10 is positioned on the lower surfaces of the excavation teeth 9 as shown in FIGS. 1 to 3, the ground-leveling plate 10 having a lateral width equal to the lateral width of the lower part of the bucket 4 as described with reference to FIG. 4, and having the coupling fittings 11 secured onto the upper surface thereof by welding 21 (see FIGS. 1 and 2).

Referring to FIG. 2, the coupling fitting 11 has a rear part that extends like a cover and has an opening 22 formed in the rear lower surface thereof and over the whole lateral width thereof. In the opening 22 is inserted the flat portion 18 formed in the end of the excavation tooth 9.

In the rear portion of the coupling fitting 11 extending like a cover is formed an elongated hole 23 extending in the direction of the width of the coupling fitting 11 as shown in FIGS. 2 and 3, and a stepped portion 24 is formed at an upper peripheral edge thereof.

A stop ring 25 in the shape of a spring washer is placed on the stepped portion 20 at the end of the excavation tooth 9, the flat portion 18 of the excavation tooth 9 is inserted in the opening 22 in the rear part of the coupling fitting 11, and a pin 27 having a groove 26 formed in the circumference thereof at an intermediate portion is inserted through the coupling fitting elongated hole 23, the stop ring 25 and the insertion hole 19. Then, the stop ring 25 is fitted in the groove 26 of the pin 27; i.e., the pin 27 is prevented from escaping. Consequently, the coupling fitting 11 is mounted on the end of the excavation tooth 9, and the ground-leveling plate 10 that is secured by the welding 21 to the lower surface of the coupling fitting 11, is secured to the lower side of the excavation tooth 9 as shown in FIG. 4, so that the ground can be leveled.

Referring to FIG. 2, a gap may develop between the upper surface of the flat portion 18 formed in the end of the excavation tooth 9 and the lower surface of the rear portion of the coupling fitting 11 extending like a cover in a state where the flat portion 18 of the excavation tooth 9 is inserted in the opening 22 in the rear portion of the coupling fitting 11. In this case, a spacer 28 of a suitable thickness in the form of a washer is placed on the stop ring 25 in the form of a spring washer that is placed on the stepped portion 20 in the end of the excavation tooth 9, and the pin 27 is inserted in the coupling fitting elongated hole 23, the spacer 28, the stop ring 25 and the insertion hole 19. Then, the stop ring 25 comes into close contact with the bottom surface of the stepped portion 20 in the end of the excavation tooth 9, and the spacer 28 comes into close contact with the lower surface of the rear portion of the coupling fitting 11 that extends like a cover, and no play occurs between the excavation tooth 9 and the coupling fitting 11.

Referring to FIG. 4, the plurality of tooth-mounting fittings 8 secured to the front part of the edge 7 may have a mounting pitch that differs in the lateral direction depending upon the manufacturers. In such a case, the central positions of the excavation teeth 9 in the lateral direction mounted on the ends of the tooth-mounting fittings 8 may not be in correct agreement with the central positions of the coupling fittings 11 in the lateral direction. However, the openings 22 in the coupling fittings 11 extend over the full lateral length of the coupling fittings 11 to absorb differences in the pitches in the products of various manufacturers. Therefore, the flat portion 18 of the excavation tooth 9 can be inserted in the opening 22 in the rear portion of the coupling fitting 11 without any trouble. Moreover, since the coupling fitting elongated holes 23 have been lengthened in the lateral direction, the pins 27 can be inserted in the coupling fitting elongated holes 23 and in the insertion holes 19 without any trouble.

The positions of the plurality of the tooth-mounting fittings 8 may become irregular in the vertical direction. By setting the position of the opening 22 of the coupling fitting 11 to be high and by interposing the spacer 28 having a suitable thickness, however, the flat portions 18 of the excavation teeth 9 can be inserted in the openings 22 in the rear portions of the coupling fittings 11 without any trouble despite the positions of the ends of the excavation teeth 9 not being uniform in the vertical direction due to irregular positioning of the tooth-mounting fittings 8 in the vertical direction. No play develops among the excavation teeth 9, coupling fittings 11 and ground-leveling plate 10.

Referring to FIGS. 1 to 3, when the pins 27 are pulled with a force larger than the anchoring force of the stop rings 25 in the state where the ground-leveling plate 10 is secured to the lower side of the excavation teeth 9, then, the ground-leveling plate 10 can be removed together with the coupling fittings 11 from the ends of the excavation teeth 9. That is, the teeth 9 are exposed enabling the excavation operation to be executed.

The excavation teeth 9 in the excavation state can be replaced by other excavation teeth 9 having different shapes and sizes by pulling the pins 17 shown in FIG. 2 toward the upper side or the lower side of the holes 15.

According to the present invention, the excavation operation and the ground-leveling operation can be alternately executed by the power shovel which is not provided with a bucket exclusively for leveling the ground. Namely, only the ground-leveling plate having coupling fittings needs to be provided, offering the merits of decreased cost, easy transportation of the machine, and easy mounting/removing operation at the site. Thus, the invention is suited for the ground-leveling operation where it is required to highly flatten the ground.

According to the preferred embodiment of the present invention, the ground-leveling plate can be mounted without any trouble despite the plurality of tooth-mounting fittings being secured to the front part of the bottom plate of the bucket at dissimilar pitches in the lateral direction or despite the coupling fittings 11 being secured to the upper surface of the ground-leveling plate 10 at dissimilar pitches in the lateral direction.

According to the further embodiment of the present invention, the ground-leveling plate is mounted without any trouble despite the plurality of tooth-mounting fittings being located at irregular positions in the vertical direction, and without producing play among the excavation teeth, coupling fittings and ground-leveling plate.

What is claimed is:

1. A bucket tool for a power shovel comprising: a bucket having a bottom plate provided at a lower part thereof; an edge member secured in a lateral direction to the bottom plate; tooth-mounting fittings secured to the edge member in a lateral direction with intervals provided between adjacent tooth-mounting fittings; excavation teeth which are detachably mounted on the tooth-mounting fittings and protrude forwardly beyond the edge member; a ground-leveling plate having a lateral width equal to the lateral width of the lower part of the bucket; coupling fittings secured to an upper surface of the ground-leveling plate with an interval provided between adjacent coupling fittings nearly equal to the interval provided between adjacent tooth-mounting fittings and detachably mounted on the ends of the excavation teeth; excavation tooth holes provided through the ends of the excavation teeth; coupling fitting elongated holes provided in the coupling fittings and being elongated in the lateral direction of the bucket; pins inserted in the excavation tooth holes and the coupling fitting elongated holes to couple the excavation teeth and the coupling fittings together; and stop rings provided between the excavation teeth and the coupling fittings and mounted to surround the pins.

2. A bucket tool for a power shovel according to claim 1, in which the bucket further comprises spacers provided together with the stop rings between the excavation teeth and the coupling fittings.

* * * * *